US005543681A

United States Patent [19]

Jo

[11] Patent Number: 5,543,681

[45] Date of Patent: Aug. 6, 1996

[54] IN-LINE TYPE ELECTRON GUNS FOR COLOR PICTURE TUBE

[75] Inventor: Sung H. Jo, Kyungsangbook-Do, Rep. of Korea

[73] Assignee: Goldstar Co., Ltd., Rep. of Korea

[21] Appl. No.: 314,203

[22] Filed: Sep. 28, 1994

[30] Foreign Application Priority Data

Sep. 28, 1993 [KR] Rep. of Korea ..... 19986/1993

[51] Int. Cl.[6] ..... H01J 29/50

[52] U.S. Cl. ..... 313/414; 313/449

[58] Field of Search ..... 313/412, 414, 313/427, 428, 432, 448, 449; 315/14, 15, 382, 382.1

[56] References Cited

U.S. PATENT DOCUMENTS

| | | | |
|---|---|---|---|
| 4,599,534 | 7/1986 | Shirai et al. | 313/414 |
| 4,672,261 | 6/1987 | Shirai et al. | 313/414 |
| 5,025,189 | 6/1991 | Son | 313/414 |
| 5,032,760 | 7/1991 | Kim | 313/414 |
| 5,300,855 | 4/1994 | Kweon | 313/414 |

*Primary Examiner*—Sandra L. O'Shea
*Assistant Examiner*—Vip Patel
*Attorney, Agent, or Firm*—Ostrolenk, Faber, Gerb & Soffen, LLP

[57] ABSTRACT

In-line type electron guns for a color picture tube. In this electron guns, the third electrode or the $G_3$ electrode is divided into two focusing electrodes, that is, first and second focusing electrodes. The envelop of the first focusing electrode has at its front end a control electrode plate provided with at least three rectangular openings, the vertical size of each the rectangular opening being larger than the horizontal size. An electrode body for electrostatic control of the three electron beams is recessed in the electrode envelop of the $G_4$ electrode. A dynamic focus voltage is applied to the second focusing electrode, thus to form a horizontally converging lens and a vertically diverging lens. The horizontally converging lens and the vertically diverging lens compensate the horizontal divergence and vertical convergence of the electron beam which are caused by the deflection magnetic fields of the deflection yoke when the electron beam is deflected to the screen comers. The in-line type electron guns improve the resolution of the screen. This electron guns also minimize the variation of the dynamic focus voltage, thus to save the power.

4 Claims, 4 Drawing Sheets

IN-LINE TYPE ELECTRON GUNS FOR COLOR PICTURE TUBE

BACKGROUND OF THE INVENTION

1. Field of the Invention

The present invention relates in general to in-line type electron guns for color picture tubes and, more particularly, to an improved structure in such in-line type electron guns for prevention of electron beam spot distortion at screen comers due to influence of deflection magnetic fields of a deflection yoke placed around the neck of the color picture tube.

2. Description of the Prior Art

As well known to those skilled in the art, the focus characteristics of the typical color picture tubes are potently influenced by apertures of electron lenses or main lenses of the electron guns. Here, the electron lenses or the main focusing lenses of electron guns of the color picture tube comprise a plurality of anodes. It is preferred to enlarge the apertures of the main lenses of the electron guns for achieving excellent focus characteristics of the color picture tube. In the color picture tube, three electron guns may be arranged in the delta type or in the in-line type. In the typical in-line type electron guns, three electron guns corresponding to three colors, that is, red (R), green (G) and blue (B) are arranged in a horizontal line, thus to be integrated into the in-line type electron guns. With the above structure comprising the three electron guns, the in-line type electron guns which are to be arranged in a limited space inside the neck of the color picture tube should be undesirably limited in both the apertures of main focusing lenses of the three electron guns and the intervals between the main focusing lenses. In this regard, the typical in-line type electron guns of the color picture tube should have a serious problem in enlarging of the main lens apertures of its three electron guns for achieving the excellent focus characteristics of the color picture tube.

The above problem will be described in detail in conjunction with the accompanying drawings.

With reference to FIG. 1, there is shown in a plan section view a color picture tube having a typical in-line type electron guns. The glass envelope of the color picture tube is designated by the numeral 1. A fluorescent screen 3 for developing a color image is mounted on the inner surface of a face plate 2 of the glass envelope 1. The screen 3 is applied with three color phosphors in the form of vertical stripes on its surface. Here, the three color vertical phosphor stripes are alternately applied on the screen 3. The center axes 15, 16 and 17 of three cathodes 6, 7 and 8 of the in-line type electron guns are placed in a horizontal line such that they are parallel with each other. The three center axes 15, 16 and 17 are aligned with centers of their respective openings of the first control grid or $G_1$ electrode 9, the second control grid or $G_2$ electrode 10, the second anode or $G_3$ electrode 11 of the electron lens. The in-line type guns also includes a shielding cup 13 in from of the first anode or of a $G_4$ electrode 12. A contact spring (not shown) is mounted on a side of the shielding cup 13. The $G_3$ electrode 11 cooperates with the first anode or the $G_4$ electrode 12 so as to form the electron lenses or the main lenses of the electron guns. This $G_4$ electrode 12 has three openings in which the center opening is concentric with the center axis 16 of the cathode 7. However, the centers 18 and 19 of opposed openings of the $G_4$ electrode 12 are eccentric from the center axes 15 and 17 of the cathodes 6 and 8 respectively. The electron beams produced by the three cathodes 6, 7 and 8 travel along their center axes 15, 16 and 17 so as to be received by the main lenses.

As best seen in FIG. 2, the main lenses of the electron guns comprises the two anodes, that is, the $G_3$ electrode 11 used as a focusing electrode and the $G_4$ electrode 12 used as an accelerating electrode. The two electrodes 11 and 12 comprise electrode envelops respectively. The electrode envelops of the electrodes 11 and 12 have their burring sections 116 and 126 each of which defines a common opening for the three electron beams and which extend to a predetermined length in opposed directions from inside edges of elliptical rims 115 and 125. The extending portion of the burring sections 116 and 126 are parallel with the outer surfaces of envelops of the electrodes 11 and 12 respectively. The elliptical tract type rims 115 and 125 of the two electrodes 11 and 12 face each other and have a predetermined width.

In FIG. 2, please let the X-X' direction, which is perpendicular to the axial direction or the beam travelling direction, be the "horizontal direction" and let the Y-Y' direction, which is perpendicular to the horizontal direction X-X', be the "vertical direction". The electrodes 11 and 12 include their control electrode plates or planes 113 and 123 that are placed in the envelops of the electrodes 11 and 12. "Plates" or "planes are used interchangeably in the present specification. The control electrode plates 113 and 123 are recessed from the rims 115 and 125 by a predetermined distance in the axial direction. The electrode plates 113 and 123 are adapted to control the electron beams. Such an electrode plate 113 or 123 has an elliptical center opening 119 or 129 whose vertical (or Y-Y' directional) size is larger than the horizontal (or X-X' directional) size. The opposed sides of each electrode plate 113 or 123 are defined by concave edges such as formed by vertically cutting the centers of elliptical openings. The opposed sides of the plate 113 or 123 thus form opposed side openings in cooperation with the envelope of electrode.

The electrical potential of $G_3$ electrode 11 is lower than that of the $G_4$ electrode 12. The higher potential of the $G_4$ electrode 14 is equal to those of the shielding cup 13 and of a conductive layer 5 applied on the inner surface of the glass envelope 1. Conventionally, the voltage applied to the $G_3$ electrode 11 is about 20%–30% of that applied to the $G_4$ electrode 12. Since the center openings 119 and 129 of the electrode plates 113 and 123 are coaxial with each other, the main lens formed in the center axis of the electrodes 11 and 12 is axially symmetrical. In this regard, the center electron beam focused by the main lens travels along the center beam path coinciding with the center axis 16.

Meanwhile, the opposed side openings of the $G_3$ electrode 11 are eccentric from those of the $G_4$ electrode 12, so that each of the side lenses formed at the opposed sides of the electrode 11 and 12 is axially asymmetrical. At the divergence sections of the side lenses formed at the $G_4$ electrode 12, the side beams thus pass through the side beam paths deflecting from the center axes of the side lenses toward the center beam path. At this time, the side beams are influenced by focusing of the side lenses and converged to the center beam path. The three electron beams are thus converged to a shadow mask 4 for color selection and image-produced thereon. The shadow mask 4 is disposed in the envelop 1 of the color picture tube such that it is spaced apart from the fluorescent screen 3. The above convergence of the three electron beams is so-called static convergence (hereinbelow, referred to simply as "STC"). At the shadow mask 4, only the components, which excite the color phosphor stripes corresponding to the respective electron beams subjected to the color selection of the shadow mask 4, are transmitted through the shadow mask 4 so as to reach the fluorescent screen 3. In the color picture tube, the electron beams 23 are scanned on the fluorescent screen 3, so that the electron beams 23 should be deflected to the screen comers using outside magnetic fields. The above object is achieved by a deflection yoke 14 which is placed on the glass envelope 1 about the neck and forms the outside magnetic fields, that is, the horizontal magnetic field and the vertical magnetic field, in the color picture tube.

In the above in-line type electron guns, the main lenses common to the three electron beams of the three cathodes are more influenced by the vertical focusing/accelerating electric field than the horizontal focusing/accelerating electric field. Each of the electron beams out of the main lenses thus shows an elliptical section whose horizontal diameter is longer than its vertical diameter. In order to compensate such elliptical shapes of the electron beams out of the main lenses, the control electrode plates 113 and 123 having their elliptical openings are placed in the envelops of the $G_3$ and $G_4$ electrodes 11 and 12 such that they are recessed from the rims 115 and 125 by the predetermined distance in the axial direction. In the elliptical openings of the control electrode plates 113 and 123, the vertical (or Y-Y' directional) diameter is longer than the horizontal (or X-X' directional) diameter and this specified structure of the elliptical openings compensates the elliptical shape of the electron beams. With the above structure of the main lenses of the in-line type electron guns, the STC which is an important characteristic of each side beam is determined by the recessed distances of the control electrode plates 113 and 123 from the rims 115 and 125. In addition, the main lenses have a difference between the horizontal convergence and the vertical convergence of the electron beams. Such a difference is so-called astigmatism.

Such an astigmatism is produced at the center of the typical in-line type electron guns on purpose. That is, the electron beams 23 scanned on the fluorescent screen 3 are influenced by the deflection magnetic fields of the deflection yoke 14, thus to be deflected to the screen comers. In this regard, the vertical convergence of the electron beams is strengthened but the horizontal convergence of the beams is weakened and this causes distortion of the electron beams. In order to prevent such a distortion of the electron beams, the typical in-line type electron guns produce the astigmatism at the center, thus to compensate the distortion of the electron beams about the screen comers. However, the generation of the astigmatism for compensation of the distortion does not completely removes the distortion but still remains the distortion of the electron beams at both the screen center and the screen comers. This causes distortion of the screen and deformation of the control electrode plates of the electron lens of the electron guns.

SUMMARY OF THE INVENTION

It is, therefore, an object of the present invention to provide in-line type electron guns for a color picture tube in which the aforementioned problems can be overcome and of which the $G_3$ electrode used as the focusing electrode of the main lens are divided into two electrodes, that is, a first focusing electrode and a second focusing electrode, thus to form a horizontally converging lens and a vertically diverging lens by applying a dynamic focus voltage, which voltage varies in accordance with deflection current, to the second focusing electrode.

In order to accomplish the above object, in-line type electron guns in accordance with an embodiment of the present invention comprises means for producing three electron beams, a pair of control grids, that is, $G_1$ and $G_2$ electrodes for controlling and accelerating the three electron beams, a pair of anodes, that is, $G_3$ and $G_4$ electrodes for forming a main focusing lens for focusing the three electron beams on the fluorescent screen, the $G_3$ electrode comprising a first focusing electrode having an elliptical electrode envelop, the envelop being common to the three electron beams and having at its front end a control electrode plate provided with at least three rectangular openings, the vertical size of each the rectangular opening being larger than the horizontal size; and a hollow second focusing electrode placed in front of the first focusing electrode with a predetermined interval therebetween, and the $G_4$ electrode being placed in front of the second focusing electrode with a predetermined interval therebetween and comprising: an elliptical electrode envelop common to the three electron beams; and an electrode body for electrostatic control of the three electron beams, the electrode body being recessed in the electrode envelop of the $G_4$ electrode.

The first focusing electrode is applied with a static focus voltage of about 20–30% of a voltage applied to the $G_4$ electrode while the second focusing electrode is applied with a dynamic focus voltage higher than the static focus voltage of the first focusing electrode by 0–500 V, the dynamic focus voltage varying with lapse of time.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
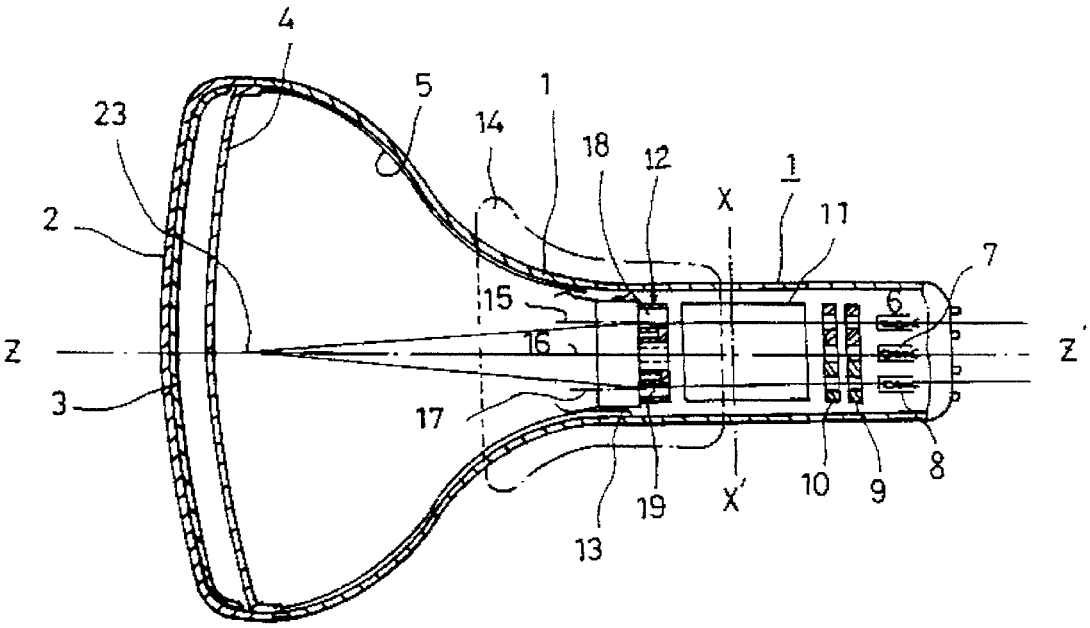
FIG. 1 CONVENTIONAL ART
FIG. 1 is a plan sectioned view of a color picture robe having typical in-line type electron guns.
Figure 2:
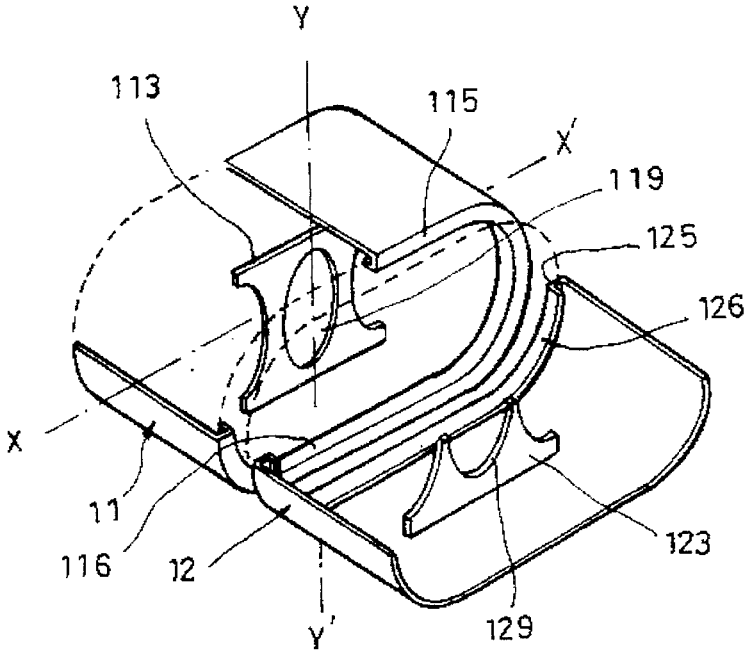
FIG. 2 CONVENTIONAL ART
FIG. 2 is an enlarged perspective view of lens forming electrodes of the typical electron guns of FIG. 1.
Figure 3:
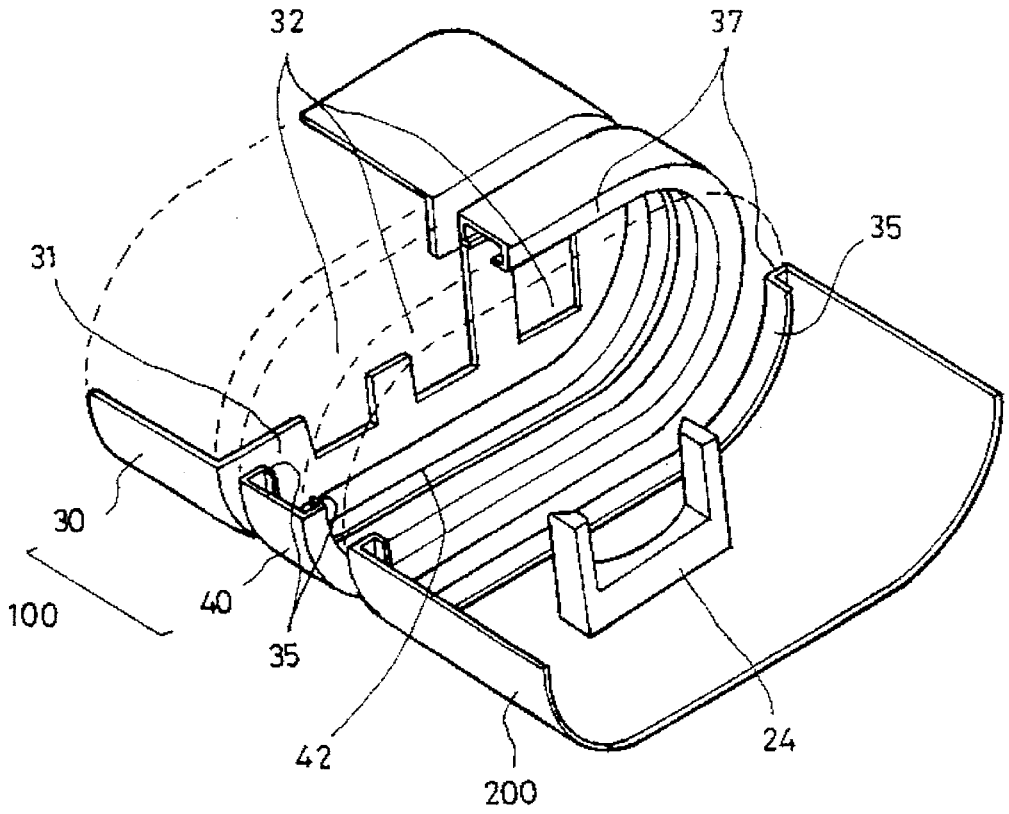
FIG. 3 is a partially broken perspective view of lens forming electrodes of in-line type electron guns in accordance with an embodiment of the present invention.

With reference to FIG. 3, there is shown lens forming electrodes of in-line type electron guns in accordance with a preferred embodiment of the present invention. In the lens forming electrodes of the in-line type electron guns of this invention, a $G_3$ electrode 100 are divided into two electrodes, that is, a first focusing electrode 30 and a second focusing electrode 40. The two focusing electrodes 30 and 40 are placed in the in-line type electron guns such that they are spaced out at a regular interval.

The first focusing electrode 30 is provided with a control electrode plate 31 at its front end. The symmetric electrode plate 31 has three rectangular openings 32 which are spaced out at regular intervals. In the present invention, the electrode plate 31 preferably has the three openings 32, however, it should be understood that four or more rectangular openings 32 may be provided in the electrode plate 31. The electron beams produced by three cathodes (not shown) of the in-line type electron guns pass through the three rectangular openings 32 respectively.

The second focusing electrode 40 is placed between and spaced apart from the first focusing electrode 30 and a $G_4$ electrode 200. This second focusing electrode 40 comprises an electrode envelop defining a common opening, through which opening the three electron beams commonly pass. The electrode envelop has opposed rims 37 of the elliptical tract type at its opposed ends. These rims 37 face the first focusing electrode 30 and the $G_4$ electrode 200 respectively. A pair of burring sections 35 extend inward from the inside edges of the opposed rims 37 of the second focusing electrode 40 to a predetermined length.

The $G_4$ electrode 200 is placed at the front of the second focusing electrode 40 of the $G_3$ electrode 100. This $G_4$ electrode 200 comprises an electrode envelop defining a common opening through which opening the three electron beams commonly pass. The electrode envelop has a rim 37 of the elliptical tract type at its end, which end faces the second focusing electrode 40. A burring section 35 extends inward from the inside edge of the rim 37 to a predetermined length. The $G_4$ electrode 200 further includes an electrode body 24 of the rectangular frame type for electrostatic control of the electron beams. In the rectangular frame type electrode body 24, the vertical size is larger than the horizontal size. Please noted that there is shown a U-shaped lower part of the rectangular frame type electrode body 24 in FIG. 3 since this drawing is a partially broken view.

The operational effect of the above in-line type electron guns will be given hereinbelow.

The $G_4$ electrode 200 is applied with a high voltage while the first focusing electrode 30 of the $G_3$ electrode 100 is applied with a static focus voltage (SVf) of about 20–30% of the high voltage of the $G_4$ electrode 200. The second focusing electrode 40 of the $G_3$ electrode 100 is applied with a voltage which is higher than the static focus voltage (SVf) of the first focusing electrode 30 by 0–500 V. The voltage applied to the second focusing electrode 40 is a dynamic focus voltage (DVf) which varies in accordance with lapse of time. That is, when the electron beams are focused on the center of the screen, there is no deflection current in the color picture tube. In this case, the static focus voltage of the first focusing electrode 30 is let be equal to the dynamic focus voltage of the second focus electrode 40. However, when the electron beams are deflected to the screen comers, there is the maximum deflection current in the color picture tube. In this case, the difference between the static focus voltage of the first focusing electrode 30 and the dynamic focus voltage of the second focus electrode 40 let be maximized.

Figure 4:
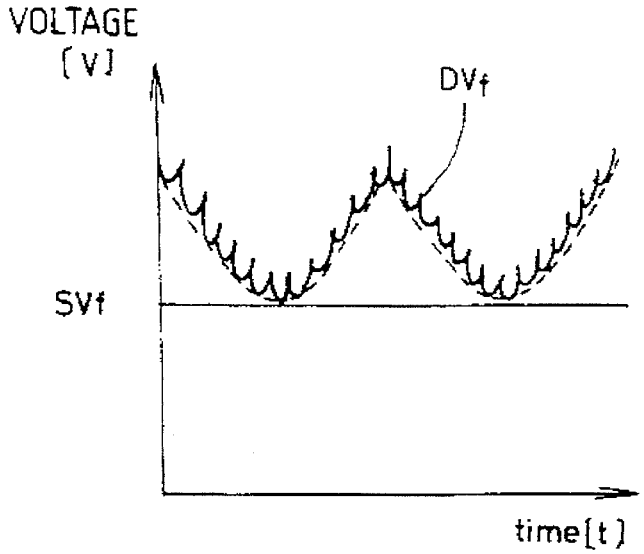
FIG. 4 is a graph showing dynamic focus voltage applied to a second focusing electrode as a function of time for the lens forming electrodes of FIG. 3.

FIG. 4 is a graph showing the dynamic focus voltage applied to the second focusing electrode 40 as a function of time.

The first focusing electrode 30 is applied with the constant static focus voltage of about 20–30% of the high voltage of the $G_4$ electrode 200 as described above. However, the second focusing electrode 40 is applied with the dynamic focus voltage higher than the static focus voltage of the first focusing electrode 30 by 0–500 V as represented in the graph of FIG. 4.

Figure 5:
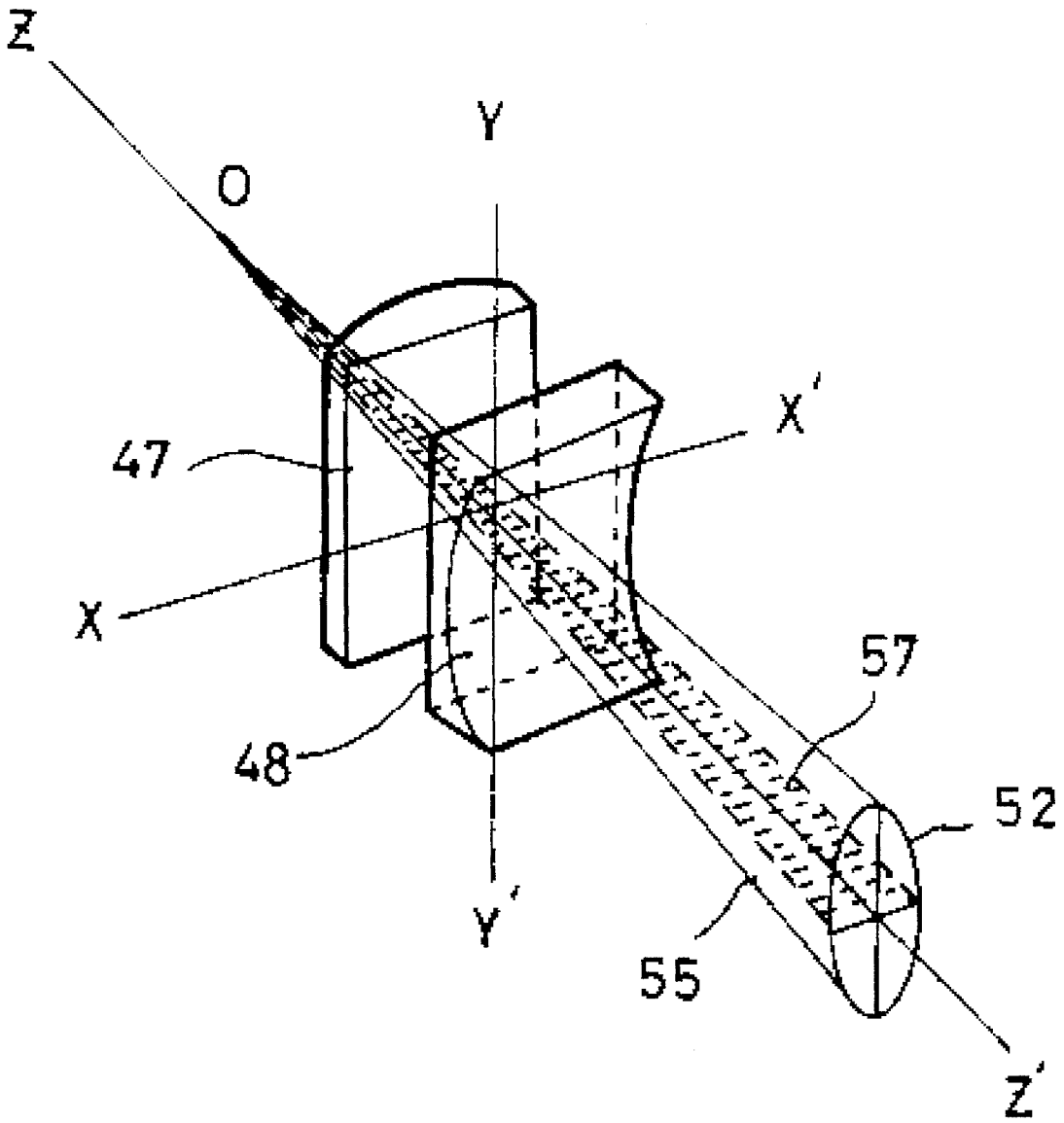
FIG. 5 is a perspective view showing an operation of a horizontally converging lens and a vertically diverging lens of the present invention.

Turning to FIG. 5, there is shown an operation of a horizontally converging lens and a vertically diverging lens of the present invention.

As shown in FIG. 5, the horizontally (X-X' directional) converging lens 47 is formed in the first focusing electrode 30 while the vertically (Y-Y' direction) diverging lens 48 is formed in the second focusing electrode 40. The electron beam 52 produced by a cathode (not shown) is converged in the horizontal direction as shown at the numeral 57 of FIG. 5. However, the electron beam 52 is diverged in the vertical direction, thus to form an elliptical-sectioned beam 55 whose horizontal size is less than the vertical size. The horizontally converging lens 47 and the vertically diverging lens 48 are strengthened in their lens actions in proportion to level of the dynamic focus voltage (DVf) of the second focusing electrode 40. When the lenses 47 and 48 are strengthened in their actions as described above, the aspect ratio of the elliptical-sectioned beam 55 is increased, thus to compensate the horizontal divergence and vertical convergence of the electron beam 52. The above horizontal divergence and the vertical convergence of the electron beam 52 are caused by the deflection magnetic fields of the deflection yoke when the electron beam 52 is deflected to the screen comers.

Figure 6:
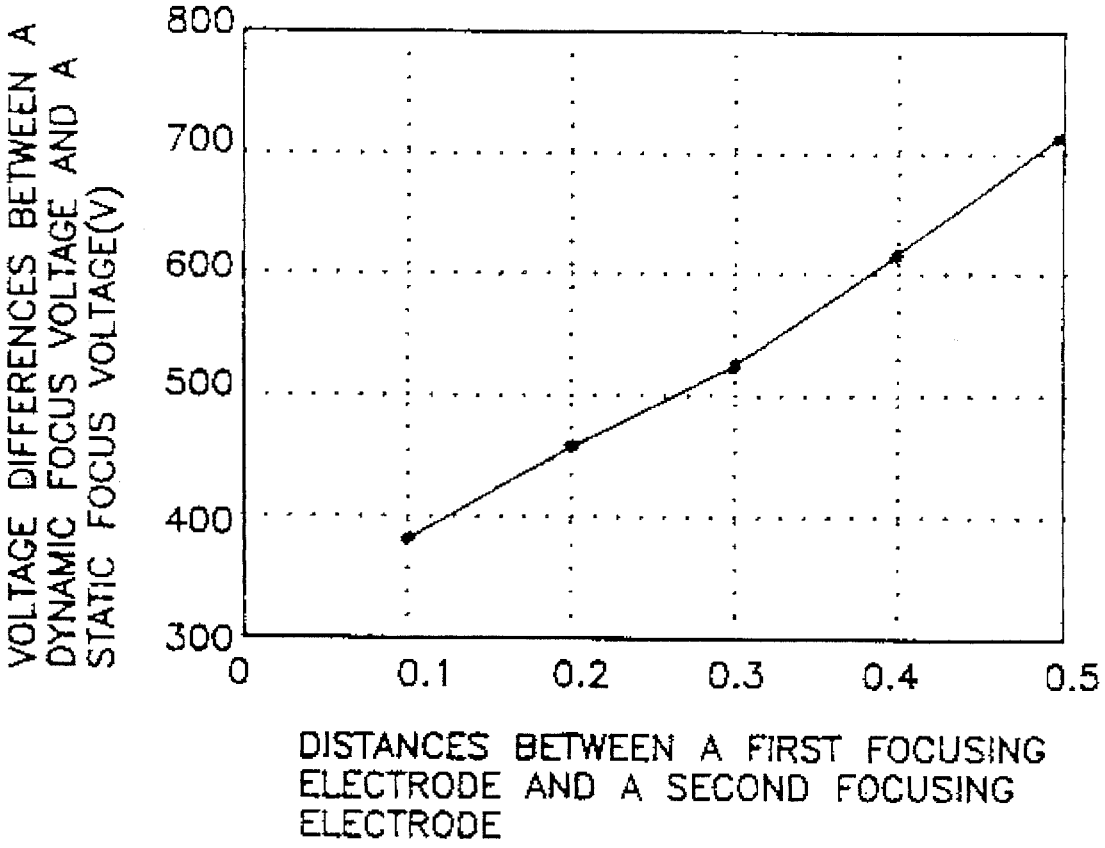
FIG. 6 is a graph showing voltage differences between a dynamic focusing voltage and a static focusing voltage with regard to the distance between a first focusing electrode and a second focusing electrode.

FIG. 6 shows voltage differences between a dynamic focusing voltage and a static a focusing voltage with regard to the distance between a first focusing electrode 30 and a second focusing electrode 40.

The strength of the lens is influenced by the distance between the first focusing electrode 30 and the second electrode 40. Therefore, the strength of the lens is strengthened by reducing the distance between the first focusing electrode 30 and the second focusing electrode 40. The price of the circuit for generating and producing the dynamic focusing voltage is reduced because the dynamic focus voltage occurred in the comer on the screen is decreased due to the distance between the first focusing electrode 30 and the second focusing electrode 40.

However, an actual distance between the first focusing electrode 30 and the second focusing electrode 40 is necessary not only to increase the strength of the lens but also to provide a space for mounting a spacer in manufacturing process(for example, beading process) which caused by an array and a distance establishing of the electrodes. Also, the thickness of the electrodes is limited due to the strength of the spacer and the difficulty in the manufacturing process thereof.

Here, the distance between the first focusing electrode 30 and the second focusing electrode 40 is 0.2 mm and the dynamic and static focusing voltages thereof are 460 V. The distance is not limited with the above dimensions but the distance is able to change according to the voltage difference between the dynamic and static focusing voltages.

As described above, the present invention provides in-line type electron guns of which the third electrode or the $G_3$ electrode is divided into two focusing electrodes, that is, first and second focusing electrodes. A dynamic focus voltage is applied to the second focusing electrode, thus to form a horizontally converging lens and a vertically diverging lens. The horizontally converging lens and the vertically diverging lens compensate the horizontal divergence and vertical convergence of the electron beam which are caused by the deflection magnetic fields of the deflection yoke when the electron beam is deflected to the screen comers. In this regard, the in-line type electron guns of this invention improve the resolution of the screen. This electron guns also minimize the variation of the dynamic focus voltage, thus to save the power.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An in-line type electron gun for a color picture tube, comprising:

means for producing three electron beams;

a pair of control grids, that is, $G_1$ and $G_2$ electrodes for controlling and accelerating said three electron beams;

a pair of anodes, that is, $G_3$ and $G_4$ electrodes for forming a main focusing lens, said main focusing lens focusing said three electron beams on a fluorescent screen, said $G_3$ electrode comprising:

a first focusing electrode having an elliptical electrode envelope, said envelope having at its front end a control electrode plane provided with at least three rectangular openings, the vertical size of each said rectangular opening being larger than the horizontal size; and a hollow second focusing electrode comprising an electrode envelope defining a common opening and having opposed rims at opposed ends thereof and placed in front of said first focusing electrode with a predetermined interval therebetween, wherein said first focusing electrode has applied thereto a static focus voltage of about 20–30% of a voltage applied to said $G_4$ electrode and said second focusing electrode has applied thereto a dynamic focus voltage higher than said static focus voltage of the first focusing electrode by 0 to 500 volts, said dynamic focus voltage varying over time; and said $G_4$ electrode being placed in front of said second focusing electrode with a predetermined interval therebetween and comprising:

an elliptical electrode envelope common to the three electron beams; and an electrode body for electrostatic control of the three electron beams, said electrode body being recessed in said electrode envelope of the $G_4$ electrode.

2. The in-line type electron guns according to claim 1, wherein said electrode body for electrostatic control of the electron beams is a rectangular frame type body, the vertical size of said body being larger than the horizontal size.

3. An in-line type electron gun for a color picture tube comprising:

means for producing three electron beams;

a pair of control grids, that is, $G_l$ and $G_2$ electrodes for controlling and accelerating said three electron beams;

a pair of anodes, that is $G_3$ and $G_4$ electrodes for forming a main focusing lens, said main focusing lens focusing said three electron beams on a fluorescent screen, said $G_3$ electrode comprising:

a first focusing electrode having an elliptical electrode envelope, said envelope having at a front end thereof a control electrode plane provided with at least three rectangular openings, the vertical size of each said rectangular opening being larger than the horizontal size; and a hollow second focusing electrode comprising an electrode envelope defining a common opening and having opposed rims at opposed ends thereof and placed in front of said first focusing electrode with a predetermined interval therebetween, wherein said first focusing electrode and said second hollow focusing electrode have applied thereto at the same time a static focus voltage of about 20–30% of a voltage applied to said $G_4$ electrode; and said $G_4$ electrode being placed in front of said second focusing electrode with a predetermined interval therebetween and comprising:

an elliptical electrode envelope common to the three electron beams; and an electrode body for electrostatic control of the three electron beams, said electrode body being recesses in said electrode envelope of the $G_4$ electrode.

4. The in-line type electron gun according to claim 3, wherein said electrode body for electrostatic control of the electron beams is a rectangular frame type body, the vertical size of said body being larger than the horizontal size.

* * * * *